United States Patent [19]

Korkia

[11] Patent Number: 4,817,539

[45] Date of Patent: Apr. 4, 1989

[54] WASTE RECLAMATION FURNACE

[76] Inventor: Edwin O. Korkia, 334 County Rd. 566, Bovey, Minn. 55709

[21] Appl. No.: 129,229

[22] Filed: Dec. 7, 1987

[51] Int. Cl.[4] ..... F23G 5/00; F23G 7/00

[52] U.S. Cl. ..... 110/243; 110/215; 110/216; 110/235; 110/259

[58] Field of Search ..... 110/235, 238, 243, 233, 110/259, 215, 216

[56] References Cited

U.S. PATENT DOCUMENTS

| | | | |
|---|---|---|---|
| 3,648,629 | 3/1972 | Southwick | 110/243 |
| 3,652,405 | 3/1972 | Hess et al. . | |
| 3,719,171 | 3/1973 | Brooks . | |
| 3,890,908 | 6/1975 | von Klenck et al. | 110/243 |
| 4,109,590 | 8/1978 | Mansfield . | |
| 4,173,190 | 11/1979 | Greenberg et al. | 110/243 |
| 4,285,282 | 8/1981 | Good . | |
| 4,437,419 | 3/1984 | Hertel . | |
| 4,599,953 | 7/1986 | Gould . | |
| 4,719,850 | 1/1988 | Sowell | 99/404 |

*Primary Examiner*—Edward G. Favors

*Attorney, Agent, or Firm*—Palmatier & Sjoquist

[57] ABSTRACT

A pollution-free waste reclamation furnace which is comprised of a forced air burn chamber for burning presorted combustible non-petroleum derivative waste. A petroleum derivative waste cooking ring-like chamber, which is at least partially surrounded by the burn chamber, has an oil bath therein for receiving and cooking petroleum derivative waste wherein the waste is heated until it melts and dissolves within the oil to form sweet crude. A solid waste cage operably moves through the oil in the ring chamber to collect undissolved non-petroleum derivative solid waste to thereby remove such undissolved solid waste from the cooking ring chamber. An exhaust stack is provided having a spiraling exhaust gas tunnel wrapped therearound wherein the tunnel is in flow communication with the burn chamber where exhaust gases rise and pass therethrough. A plurality of steam jets are within the tunnel along with a plurality of openings permitting communication between the tunnel and the inside of the stack. By this arrangement, the exhaust gas is scrubbed or purged and the resulting sludge and ash are dropped into the stack, dried and deposited into a collector chute for appropriate removal from the furnace.

20 Claims, 3 Drawing Sheets

WASTE RECLAMATION FURNACE

BACKGROUND OF THE INVENTION

This invention relates to a pollution-free waste reclamation furnace which reclaims sweet crude from petroleum derivative waste or garbage and does so while burning combustible non-toxic and non-petroleum derivative waste or garbage in an efficient manner.

Typical waste or garbage includes petroleum derivatives, such as plastic, some fabrics, grease, oil, fats, rubber and styrofoam. Other non-petroleum derivative waste includes metal, glass, some fabrics and wood.

Generally, municipal waste or garbage is collected and burned without attempts to salvage certain constituents thereof. Economical and ecological disposal with reclamation of solid municipal waste has been the objective of many systems. However, high capital costs and low conversion efficiency have stifled much research in this area.

Current state-of-the-art waste disposal systems have their fall backs. They primarily focus upon shredding of all the waste or garbage with little or no sorting or separation. Incineration is next with perhaps some purging of the exhaust gases prior to their release into the atmosphere. The incineration of petroleum derivative wastes adversely introduces dioxin contamination into the atmosphere and totally destroys what ever possibly may have been reclaimed for further refinement from the petroleum derivative waste.

SUMMARY OF THE INVENTION

A pollution-free waste reclamation furnace which is comprised of a forced air burn chamber for burning presorted combustible non-petroleum derivative waste. A petroleum derivative waste cooking ring-like chamber, which is at least partially surrounded by the burn chamber, has an oil bath therein for receiving and cooking petroleum derivative waste wherein the waste is heated until it melts and dissolves within the oil to form sweet crude. A solid waste cage operably moves through the oil in the ring chamber to collect undissolved (non-petroleum derivative) solid waste to thereby remove such undissolved solid waste from the cooking ring chamber. An exhaust stack is provided having a spiraling exhaust gas tunnel wrapped therearound wherein the tunnel is in flow communication with the burn chamber where exhaust gases rise and pass therethrough. A plurality of steam jets are within the tunnel along with a plurality of openings permitting communication between the tunnel and the inside of the stack. By this arrangement, the exhaust gas is scrubbed or purged and the resulting sludge and ash are dropped into the stack, dried and deposited into a collector chute for appropriate removal from the furnace.

A principal object and advantage of this invention is that the furnace separates petroleum derivative from non-petroleum derivative waste or garbage wherein the non-petroleum waste is burned to heat, melt and dissolve the petroleum derivative waste thereby permitting efficient reclamation of the petroleum derivative waste into a usable sweet crude form which may further be refined.

Another object of this invention is that the exhaust stack design effectively scrubs or purges the exhaust gases which are by-products in the combustion of the non-petroleum derivative waste to effectively diminish pollution which otherwise may be caused by the furnace.

Another object of this invention includes the further refinement of the oil within the furnace and the petroleum derivative waste dissolved therein (sweet crude) through the operable connection to a cracking tower.

Another feature of this invention includes its small and compact design which minimizes the necessary space needed for such a waste reclamation furnace.

DETAILED DESCRIPTION OF THE INVENTION

Figure 1:
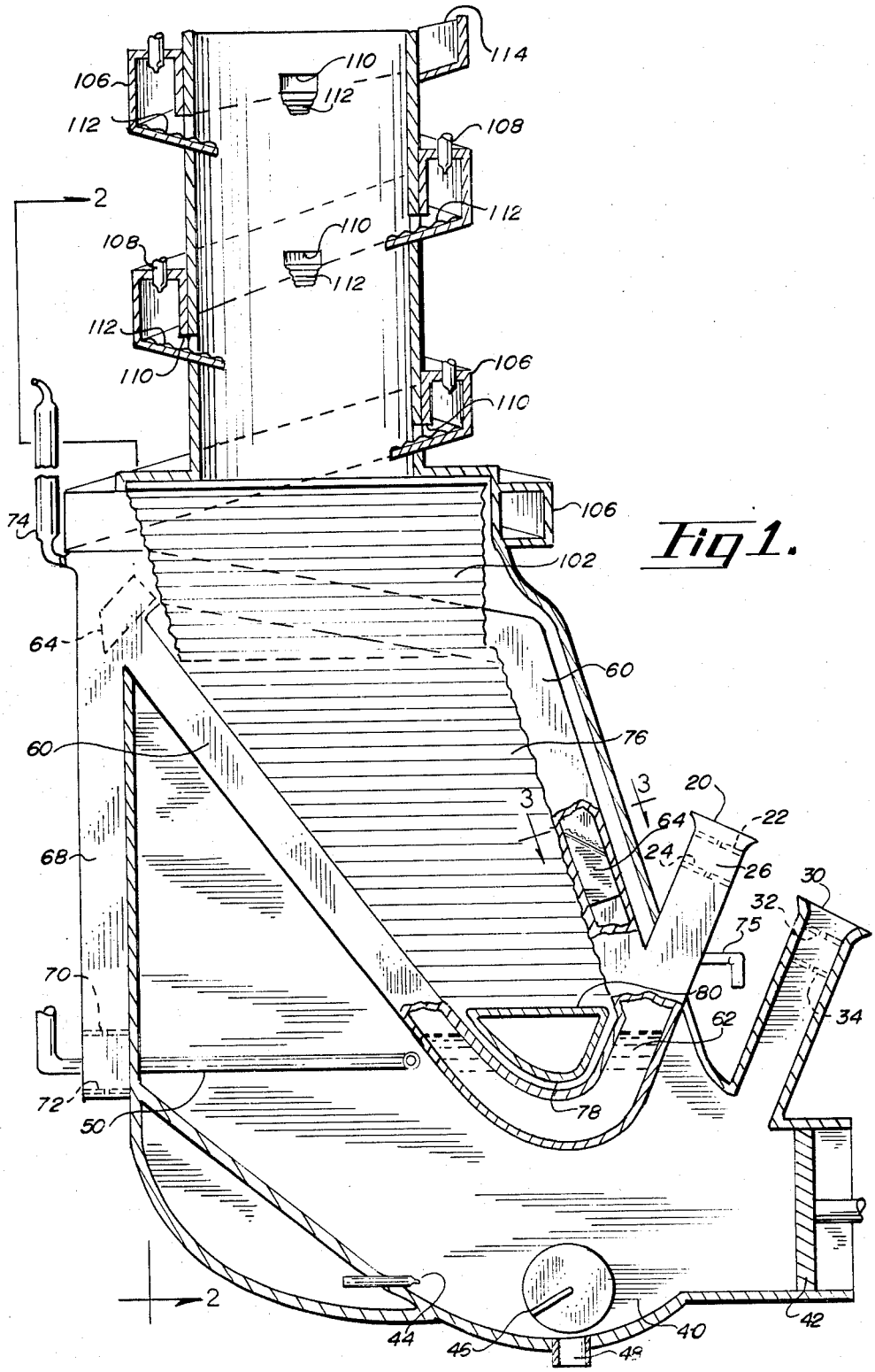
FIG. 1 is a vertical cross-sectional view along lines 1—1 of FIG. 2.
Figure 2:
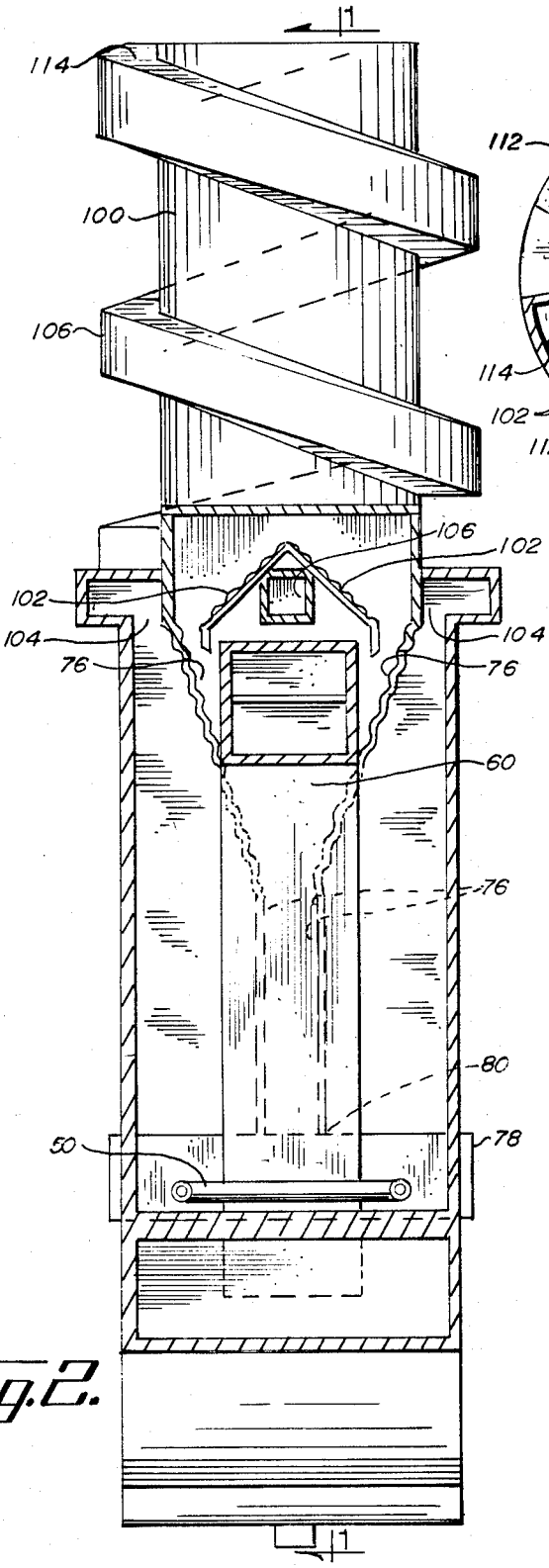
FIG. 2 is a stepped vertical cross-section taken along lines 2—2 of FIG. 1.
Figure 4:
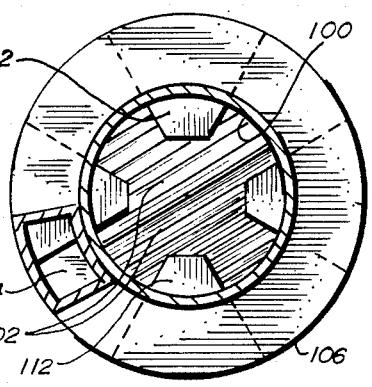
FIG. 4 is a top view of the stack taken from FIG. 1.
Figure 3:
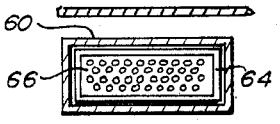
FIG. 3 is a broken away cross-section taken along lines 3—3 of FIG. 1.

Referring to FIGS. 1–4, the waste reclamation furnace 10 may be seen. The principal components of furnace 10 include burn chamber 40, petroleum derivative waste cooking ring or chamber 60, exhaust stack 100 and waste sorting apparatus 120.

Furnace 10 has a petroleum derivative waste loading chute 20 preferably with two air lock drop doors 22 and 24 which suitably form waste loading chamber 26 therebetween. A second chute, referred to as combustible non-petroleum derivative waste loading chute 30, includes air lock drop doors 32 and 34 with burnable waste loading chamber 36 therebetween.

Combustible waste loading chute 30 is connected to burn chamber 40 and opens up thereinto adjacent loading ram 42. Burn chamber 40 includes forced air burners 44 and sludge and ash auger 46 located at the central regions of the bottom of the burn chamber 40 appropriately just above ash drop chute 48. Water conduit 50 enters and leaves the burn chamber 40 for the generation of steam.

Petroleum waste loading chute 20 appropriately opens up into petroleum derivative waste cooking chamber, or circular ring 60, which has an oil bath 62 in its lower portion. Oil bath 62 suitably may consist of used automobile oil or the like. Solid waste cage 64, with perforations or holes 66 therein, is appropriately chain and motor driven so that it may operably move throughout the cooking ring 60.

Non-petroleum dump chute 68 is in flow communication with cooking ring 60 and appropriately has air lock drop doors 70 and 72. Waste materials that do not dissolve in oil bath 62 are simply carried by cage 64 and removed from the ring 60 by dumping the solid waste into dump chute 68.

Conventional cracking tower 74 is appropriately in flow and operable communication with petroleum derivative waste cooking ring 60 for distillation of gas and oil by-product of the cooking ring. Oil overflow drainage tube 75 suitably drains excess oil from oil bath 62 to assure that the cooking ring 60 does not become flooded.

Corrugated exhaust deflector panels 76 appropriately deflect the exhaust gases within burn chamber 40 upwardly thereout while drying sludge and ash that has been reclaimed from the exhaust gases and deposited into reclaimed sludge and ash collection chute 78 through deflector opening 80 for appropriate removal from furnace 10 to be discussed in detail hereinbelow.

Exhaust stack 100 is of a novel design and is located generally above burn chamber 40. Reclaimed sludge and ash deflectors 102, adjoined at their uppermost edges, appropriately protect the cooking ring 60 from reclaimed falling sludge and ash as well as other particulates.

Exhaust gas opening 104 is appropriately connected to exhaust gas tunnel 106 whereby the exhaust gases from the burn chamber 40 are directed therethrough by deflector panels 76. Exhaust gas tunnel 106 appropriately spirals about the exterior of exhaust stack 100 and carries the exhaust gases up and away from the burn chamber 40.

Steam jets 108 are located within tunnel 106 and receive steam generated from water conduit 50 within burn chamber 40. Tunnel sludge and ash openings 110 are located within tunnel 106 and appropriately communicate tunnel 106 with the interior of exhaust stack 100. Corrugated ramps 112 appropriately extend from tunnel openings 110 to direct the precipitated sludge and ash from the exhaust gases into the central interior regions of exhaust stack 100.

As the precipitated sludge and ash falls into the central regions of exhaust stack 100, the wet sludge and ash travels around the cooking ring 60 over the inclined and corrugated hot sludge ash deflectors 102. Thereafter, the wet sludge and ash falls upon the corrugated exhaust and deflector panels 76, which are heated by the exhaust gases within the burn chamber 40, to effectively dry the ash and sludge which then may be collected from collection chute 78. Tunnel 106 opens to the atmosphere at the top of exhaust stack 100 through tunnel atmospheric exhaust gas opening 114.

Figure 5:
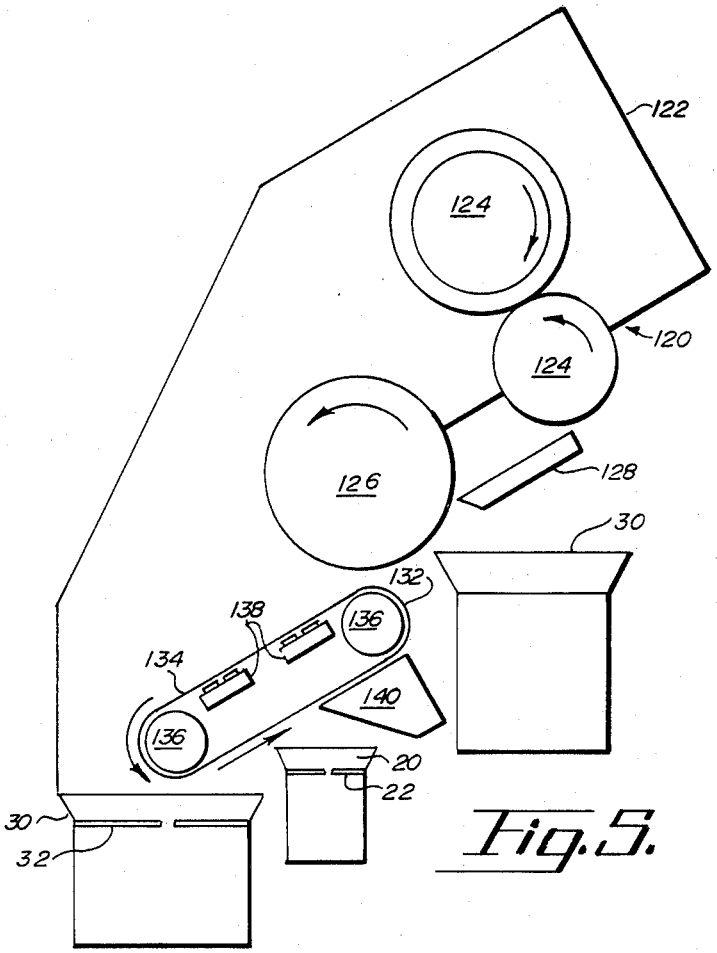
FIG. 5 is a schematic plan view of a waste sorting apparatus.

Referring to FIG. 5, a schematic plan of the waste sorting apparatus 120 for the waste reclamation furnace 10 may be seen. Sorting chute 122 receives the waste which is appropriately and suitably directed over cutting and crushing drums 124. Thereafter, the waste is directed over magnetic drum 126, which may be a magnetized belt and drum arrangement with scraper 128 for separating ferrous metals which drop into ferrous metal chute 130.

Thereafter, the remaining waste is deposited upon petroleum derivative waste separator 132, which includes flexible metallic belt 134 suitably mounted on two spaced apart rotatable drums 136. Heater 138 is located between rotatable drums 136 and effectively heats the top portion of metallic belt 134 which will cause petroleum derivative waste to stick thereto only to be removed by scraper 140 and deposited into petroleum derivative waste loading chute 20 (see FIG. 1). Finally, the remaining waste substantially comprised of combustible non-petroleum derivatives falls into loading chute 30 (see FIG. 1).

In operation, waste, such as glass metal, fiber, plastic, paper, fabrics, grease, oil, fats, rubber and styrofoam, etc., is dumped into sorting chute 122 of waste sorting apparatus 120. Plastic garbage bags are appropriately slit open by the action of cutting and crushing drums 124, which may also permit small waste particles to pass thereby as well as crush and grind larger waste articles to manageable sizes for furnace 10. As the waste passes over magnetic drum 126, ferrous metals are attracted thereto and scraped off by scraper 128 and deposited into ferrous metal chute 130 for further refinement or separation.

As the remaining waste travels forward, there should be substantial amounts of petroleum derivative waste, including plastics, bottles, bags, rubber, styrofoam and the like, along with combustible waste. The remaining waste to be sorted is deposited upon the flexible metallic belt 134 which is heated by heater 138 causing the petroleum derivative waste to stick thereto while other wastes such as wood and paper fall off belt 134. The petroleum derivatives that are stuck to belt 134 are removed by scraper 140 and dropped or deposited into petroleum derivative waste loading chute 20, while the remaining combustible waste is deposited into combustible loading chute 30.

Combustible waste material is appropriately held in holding or load chamber 36 between air lock drop doors 32 and 34 which prevent a fire within combustible loading chute 30. When it is desirable to burn the combustible waste, drop door is 34 is opened and waste falls into burn chamber 40 and is moved into position for burning by forced air burners 44 by the action of conventional ram 42. As the waste begins to burn, auger 46 agitates the waste to insure complete burning and to keep the burn chamber relatively free of glass and metal as well as ash and sludge by directing such materials into drop chute 48 afterwhich it is removed from furnace 10 for appropriate further sorting or refinement.

The exhaust gases produced in burn chamber 40 are directed or deflected to exhaust gas openings 104 which open into tunnel 106 with the aid of corrugated exhaust deflector panels 76. As the exhaust gases travel through tunnel 106 about exhaust stack lock the steam jets 108, which are fed by water conduit 50 within the burn chamber 40, effectively wash, scrub and/or purge the exhaust gases to precipitate sludge and ash and other particulates from the exhaust gases within tunnel 106. The wet precipitated sludge, ash and particulates slide out of tunnel 106 into the central regions of exhaust stack 100 via corrugated tunnel ramps 112. The remaining exhaust gases leave the furnace 10 through exhaust gas opening 114 in tunnel 106 at the top of furnace 10.

As the precipitated wet sludge, ash and particulates fall within exhaust stack 100, they are initially deposited upon inclined hot sludge ash deflectors 102 which evenly distribute the wet sludge, ash and particulates upon the inner side of the corrugated exhaust deflector panels 76 which are heated by the exhaust gases which pass along their outer side within burn chamber 40. As the wet particular sludge and ash slides down corrugated deflector panels 76, the sludge, ash and particulates are dried and deposited into collection chute 78 through deflector opening 80 afterwhich they may be removed from furnace 10.

After furnace 10 has been fired up and petroleum derivative waste cooking ring 60 has become heated, the operator then may operate air lock drop doors 22 and 24 to effectively drop the petroleum derivative waste from load chamber 26 into hot cooking ring 60. Cooking ring 60 is continued to be heated by the action of forced air burners 44 and the burning of combustible waste within burn chamber 40. As the petroleum derivative waste comes into contact with the hot oil bath 62, it begins to melt and dissolve within the oil bath 62. Solid waste cage 64, suitably operated by the combination of a chain and motor, then passes through the oil bath 62 to appropriately collect the non-petroleum derivative waste, such as bottle caps and the like, which are lifted out of the oil bath 52 and dumped from cooking ring into non-petroleum dumping chute 68. Cage 64 has small holes or perforations 66 therein to permit the drainage of oil back into oil bath 62. The solid waste within dump chute 68 may be controllably removed from furnace 10 by the action of air lock drop doors 70 and 72 for further processing or refinement.

As the oil bath 62 continues to increase in volume and temperature, cracking tower 74 in flow communication therewith may begin operating to separate the various volatile gases and like petroleum products as well as heavy petroleum products in a refined and pure fashion as is conventionally known. If the oil bath 62 reaches too high a level within cooking ring 60, oil overflow drainage tube 75 suitably may remove some of the oil which may also be termed sweet crude oil for further refinement.

The present invention may be embodied in other specific forms without departing from the spirit or essential attributes thereof. Therefore, the illustrated embodiment should be considered in all respects as illustrative and not restrictive, reference being made to the appended claims rather than to the foregoing description to indicate the scope of the invention.

What is claimed is:

1. A pollution-free waste reclamation furnace, comprising (a) a petroleum derivative waste cooking chamber with an opening sealable with a door having an oil bath therein for receiving and cooking petroleum derivative waste fed into the chamber through the opening wherein the waste is heated until it melts and dissolves within the oil; and (b) solid waste cage operably designed to move through the oil in the cooking chamber to collect undissolved solid waste and to remove such solid waste through the opening.

2. A pollution-free waste reclamation furnace of claim 1 wherein the chamber is sealable, heated from beneath and has a cracking tower in flow communication therewith for collecting petroleum distillates which may be the by-product of the dissolved petroleum derivative waste within the oil.

3. The furnace of claim 1 wherein the cooking chamber comprises a hollow ring structure with the solid waste cage moveably located therein.

4. The furnace of claim 1, further comprising a burn chamber substantially enclosing the petroleum derivative cooking chamber for burning combustible non-petroleum derivative waste beneath the cooking chamber to effectively heat the cooking chamber.

5. The furnace of claim 4, further comprising a forced air burner in the burn chamber to assist in the burning of the combustible non-petroleum derivative waste.

6. The furnace of claim 4, further comprising a combustible non-petroleum derivative waste loading chute in flow communication with the burn chamber with two air lock doors therein.

7. The furnace of claim 6, further comprising a loading ramp beneath the chute for moving the combustible waste towards the forced air burner.

8. The furnace of claim 4, further comprising an auger located in the bottom of the burn chamber and an ash and unburnable waste drop chute beneath the auger for removing the ash and noncombustible wastes from the burn chamber.

9. The furnace of claim 4, further comprising an exhaust stack having a spiraling tunnel wrapped therearound which is in flow communication with the burn chamber.

10. The furnace of claim 9, wherein the tunnel has a plurality of steam jets therein and a plurality of openings communicating with the inside of the stack for scrubbing and purging the exhaust gas of sludge, ash and particulates.

11. The furnace of claim 9, further comprising a panel in the burn chamber for directing the exhaust gas into the tunnel and for catching and drying the sludge, ash and particulates which fall onto the other side of the panel from the stack.

12. The furnace of claim 10, further comprising a conduit with water therein located in the burn chamber for generating steam and being in flow communication with the steam jets.

13. The furnace of claim 11, wherein the panel is corrugated.

14. The furnace of claim 11, further comprising a sludge, ash and particulate collector chute below the panel for collecting sludge, ash and particulates scrubbed and purged from the exhaust gas in the tunnel.

15. The furnace of claim 1, further comprising a petroleum derivative waste loading chute connected to the opening of the cooking chamber with two air lock doors therein.

16. The furnace of claim 1, further comprising a second opening having a non-petroleum dump chute connected to the second opening with two air lock doors therein.

17. The furnace of claim 1, further comprising a petroleum derivative waste sorting apparatus comprised of a flexible metallic belt rotatably mounted upon two spaced apart drums with a heater between the two drums and a scraper to remove the petroleum derivative waste stuck to the belt.

18. A pollution-free waste reclamation furnace, comprising:

(a) a burn chamber for burning combustible non-petroleum derivative waste;

(b) a petroleum derivative cooking chamber sealable with a door at least partly enclosed by the burn chamber having an oil bath therein for receiving and cooking petroleum derivative waste wherein the waste is heated until it melts and dissolves with the oils; and (c) a solid waste edge suitably designed to move through the oil in the cooking chamber to collect undissolved solid waste and to remove such solid waste from the cooking chamber.

19. A pollution-free reclamation furnace, comprising:

(a) a burn chamber for burning combustible non-petroleum derivative waste;

(b) an exhaust stack having a spiraling tunnel wrapped around the stack which is flow communication with the burn chamber; and (c) a plurality of steam jets within the tunnel and a plurality of openings within the tunnel communicating with the inside of the stack for scrubbing and purging the exhaust gas of sludge, ash and particulates which are dropped into the stack.

20. A pollution-free waste reclamation furnace, comprising:

(a) a burn chamber for burning combustible non-petroleum derivative waste;

(b) a petroleum derivative waste cooking chamber at least partially enclosed by the burn chamber having an oil bath therein for receiving and cooking petroleum derivative waste wherein the waste is heated until it melts and dissolves within the oil;

(c) a solid waste cage operably designed to move through the oil in the cooking chamber to collect undissolved solid waste and to remove such solid waste from the cooking chamber;

(d) an exhaust stack having a spiraling tunnel wrapped around the stack which is flow communication with the burn chamber; and (e) a plurality of steam jets within the tunnel and a plurality of openings within the tunnel communicating with the inside of the stack for scrubbing and purging the exhaust gas thereby depositing sludge, ash and particulates into the stack.

* * * * *

UNITED STATES PATENT AND TRADEMARK OFFICE

CERTIFICATE OF CORRECTION

PATENT NO. : 4,817,539

DATED : April 4, 1989

INVENTOR(S) : Edwin O. Korkia

It is certified that error appears in the above-identified patent and that said Letters Patent is hereby corrected as shown below:

Column 6, line 45, "with" should read --within--.

Signed and Sealed this

Twelfth Day of February, 1991

*Attest:*

HARRY F. MANBECK, JR.

*Attesting Officer*

*Commissioner of Patents and Trademarks*